US008116663B2

(12) United States Patent
Kouzu

(10) Patent No.: US 8,116,663 B2
(45) Date of Patent: Feb. 14, 2012

(54) IMAGE FORMING APPARATUS WITH A SECONDARY-TRANSFER-ROLLER RELEASING MECHANISM

(75) Inventor: Norio Kouzu, Shizuoka (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 635 days.

(21) Appl. No.: 12/271,284

(22) Filed: Nov. 14, 2008

(65) Prior Publication Data

US 2009/0129815 A1 May 21, 2009

Related U.S. Application Data

(60) Provisional application No. 60/988,754, filed on Nov. 16, 2007.

(51) Int. Cl.
*G03G 15/16* (2006.01)

(52) U.S. Cl. ..... 399/121; 399/313

(58) Field of Classification Search ..... 399/121, 399/124, 302, 303, 313
See application file for complete search history.

(56) References Cited

U.S. PATENT DOCUMENTS 7,302,209 B2 * 11/2007 Kurita ..... 399/124
7,616,916 B2 * 11/2009 Hozono et al. ..... 399/121
7,676,176 B2 * 3/2010 Fujiwara et al. ..... 399/121

FOREIGN PATENT DOCUMENTS

JP 2006-011184 12/2006

* cited by examiner

*Primary Examiner* — William J Royer
(74) *Attorney, Agent, or Firm* — Patterson & Sheridan, LLP

(57) ABSTRACT

An image forming apparatus includes a coupling arm that moves, when a release handle is pulled up, in association with the movement of the release handle and separates a secondary transfer roller from a secondary-transfer-roller positioning member. The image forming apparatus includes a pivoting arm having a push-down spatula that moves, when the release handle is pulled up, in association with the movement of the release handle and separates the secondary transfer roller from the secondary-transfer-roller positioning member. The coupling arm or the pivoting arm transmits force applied to the release handle to the secondary transfer roller using leverage to thereby separate the secondary transfer roller from the secondary-transfer-roller positioning member and release the secondary transfer roller.

21 Claims, 4 Drawing Sheets

-- Related Art --

IMAGE FORMING APPARATUS WITH A SECONDARY-TRANSFER-ROLLER RELEASING MECHANISM

CROSS-REFERENCE TO RELATED APPLICATION

This application is based upon and claims the benefit of priority from the prior U.S. patent application Ser. No. 60/988,754, filed on 16 Nov. 2007, the entire contents of which are incorporated herein by reference.

TECHNICAL FIELD

The present invention relates to image forming apparatuses such as a copying machine and a printer, and, more particularly to an image forming apparatus with operability during maintenance improved.

BACKGROUND

An image forming apparatus includes a secondary transfer roller in order to bring an image bearing member such as a transfer belt and a recording medium into press contact with each other and transfer an image onto the recording medium. For example, when a jam occurs or when maintenance is necessary, the press-contact of the secondary transfer roller needs to be released to separate the secondary transfer roller from the transfer belt.

Concerning this point, in a mechanism proposed in JP-A-2006-11184, when a part of a housing is opened, a secondary transfer roller moves following the opening of the part of the housing and separates from a transfer belt.

However, in this technique, mechanisms associated with the part of the housing increases. Therefore, a large force is necessary to open the housing and operability is deteriorated.

To cope with this problem, provision of a lever exclusively used for separating the secondary transfer roller is proposed. FIG. 5 is a diagram of a releasing mechanism for the secondary transfer roller by this related art.

As shown in FIG. 5, in the releasing mechanism in the past, when a release handle 101 is pulled up in a direction of an arrow X, an arm 102 pivots to push down a secondary transfer roller 11 and move the secondary transfer roller 11 along a track A.

However, a large force is necessary when a secondary-transfer-roller-side positioning member 109 climbs over a contact portion 106A of a positioning member 106. As a result, smooth release of the secondary transfer roller 11 cannot be realized.

SUMMARY

It is an object of the present invention to provide an image forming apparatus in which a secondary transfer roller can be smoothly released without being caught.

In an aspect of the present invention, an image forming apparatus includes:

a recording medium feeding mechanism that feeds recording media one by one;

a recording medium conveying path to convey the recording medium fed by the recording medium feeding mechanism to a recording medium discharging unit;

an image forming unit that is arranged further on an upstream side than the recording medium discharging unit on the recording medium conveying path and executes an image forming process to print an image based on image data on the recording medium conveyed through the recording medium conveying path;

a release handle pivotably locked to a support arm that slidably supports a secondary transfer roller of the image forming unit; and an arm that separates, when the release handle is pulled, the secondary transfer roller from a secondary-transfer-roller positioning member using leverage.

DETAILED DESCRIPTION

Throughout this description, the embodiments and examples shown should be considered as exemplars, rather than limitations on the apparatus and methods of the present invention.

Image forming apparatuses according to embodiments of the present invention are explained in detail below with reference to the accompanying drawings.

Overview of an Image Forming Apparatus

Figure 6:
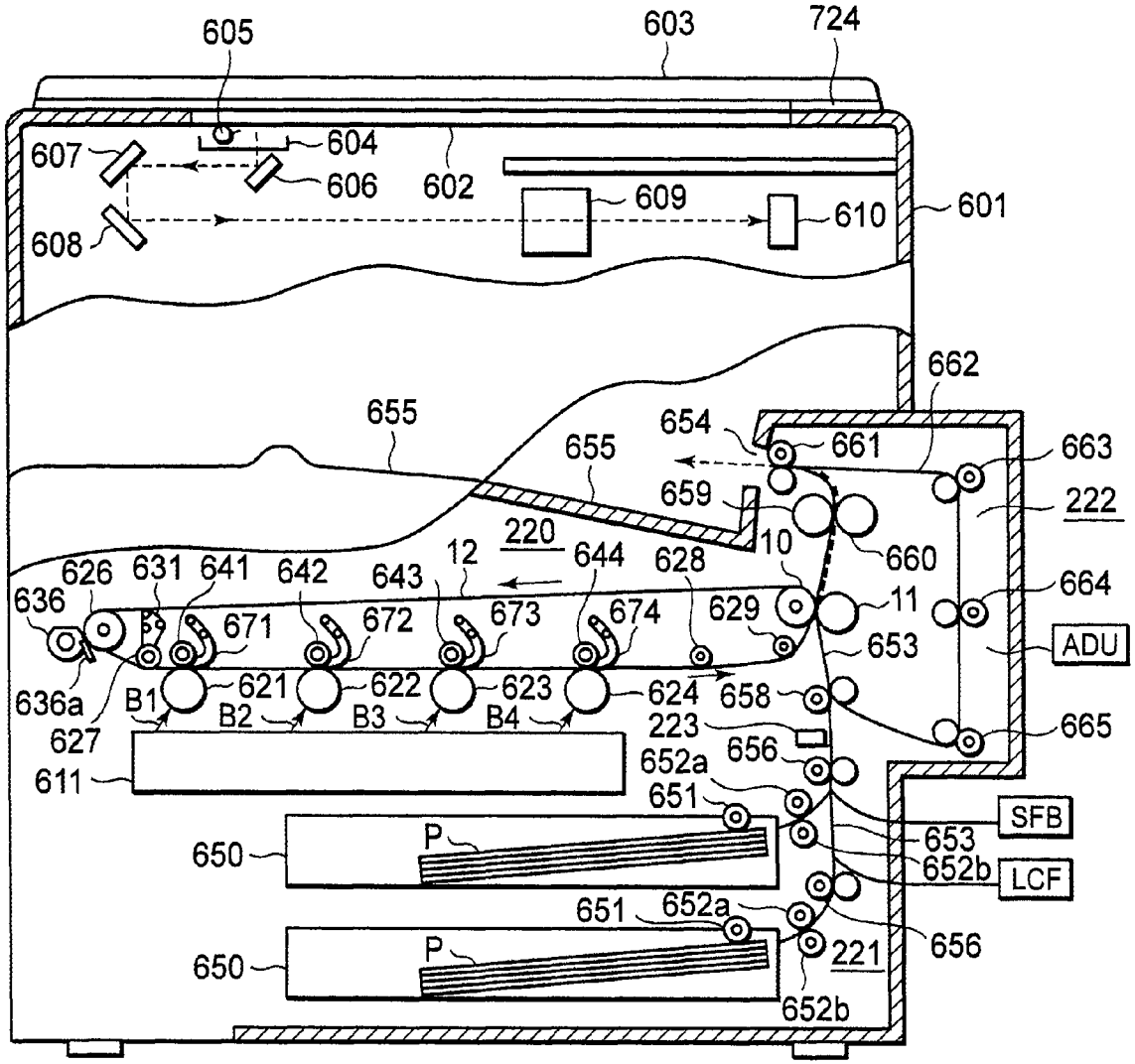
FIG. 6 is a diagram of a configuration example of an image forming apparatus.

FIG. 6 is a diagram of a configuration example of an image forming apparatus. As shown in FIG. 6, an original stand 602 for original placement formed of a transparent material such as a glass plate is provided in an upper part of an apparatus main body 601. A cover 603 is openably and closably set in the apparatus main body 601 to cover the original stand 602.

A scan unit (not shown) that optically scans an image of an original placed on the original stand 602 is provided on a lower surface side of the original stand 602 in the inside of the apparatus main body 601. The scan unit includes, for example, a carriage 604, reflection mirrors 606, 607, and 608 that reflect light of an exposure lamp 605 reflected on the original, a lens block for magnification 609 that magnifies the reflected light, and a CCD (Charge Coupled Device) 610. The carriage 604 includes the exposure lamp 605 that irradiates light toward the original stand 602. The carriage 604 can reciprocatingly move along a lower surface of the original stand 602.

The carriage 604 reciprocatingly moves while lighting the exposure lamp 605 to thereby expose the original placed on the original stand 602 to light. A reflected light image of the original, which is placed on the original stand 602, formed by this exposure is projected on the CCD 610 through the reflection mirrors 606, 607, and 608 and the lens block for magnification 609. The CCD 610 outputs image data corresponding to the reflected light image of the original projected thereon.

An image forming unit 220 is provided below the scan unit in the inside of the apparatus main body 601. The image forming unit 220 includes, for example, a print engine (not shown) and a process unit (not shown).

The print engine includes an exposing unit 611. The process unit includes photoconductive drums 621, 622, 623, and 624 arranged along the exposing unit 611.

Further, the process unit includes an endless transfer belt 12 arranged to be opposed to the exposing unit 611 across the photoconductive drums 621, 622, 623, and 624.

Moreover, the process unit includes a drive roller 626 that drives the transfer belt 12 and primary transfer rollers 641, 642, 643, and 644 arranged to be opposed to the photoconductive drums 621, 622, 623, and 624 across the transfer belt 12.

Furthermore, the process unit includes a transfer roller driving unit that drives the primary transfer rollers 641, 642, 643, and 644.

The transfer belt 12 is laid over the drive roller 626, guide rollers 627, 628, and 629, and a driven roller 10 and receives power from the drive roller 626 to rotationally travel in the counterclockwise direction. The guide roller 627 is provided to freely move up and down. The guide roller 627 receives pivoting of a cam 631 to move to the transfer belt 12 side. Consequently, the guide roller 627 changes a position of the transfer belt 12 to the photoconductive drums 621, 622, 623, and 624 side.

The image forming unit 220 executes an image forming process for forming an image based on image data (an image signal outputted from the CCD 610) and printing the image on a recording medium being conveyed. The image signal outputted from the CCD 610 is appropriately processed and, then, supplied to the exposing unit 611.

The exposing unit 611 emits a laser beam B1 corresponding to an image signal of a yellow color to the photoconductive drum 621 for the yellow color. The exposing unit 611 emits a laser beam B2 corresponding to an image signal of a magenta color to the photoconductive drum 622 for the magenta color. The exposing unit 611 emits a laser beam B3 corresponding to an image signal of a cyan color to the photoconductive drum 623 for the cyan color. The exposing unit 611 emits a laser beam B4 corresponding to an image signal of a black color to the photoconductive drum 624 for the black color.

The primary transfer rollers 641, 642, 643, and 644 are moved (lowered) to the transfer belt 12 side to thereby bring the transfer belt 12 into contact with the photoconductive drums 621, 622, 623, and 624 and transfer visible images on the photoconductive drums 621, 622, 623, and 624 onto the transfer belt 12.

A drum cleaner, a charge removing lamp, a charging unit, and a developing unit, which are not shown in the figure, are disposed in order around the photoconductive drum 621. The drum cleaner has a drum cleaning blade that is in contact with the surface of the photoconductive drum 621. The drum cleaner scrapes off a developing material remaining on the surface of the photoconductive drum 621 using the drum cleaning blade.

The charge removing lamp removes charges remaining on the surface of the photoconductive drum 621. The charging unit applies high voltage to the photoconductive drum 621 to thereby charge the surface of the photoconductive drum 621 with electrostatic charges. The laser beam B1 emitted from the exposing unit 611 is irradiated on the charged surface of the photoconductive drum 621. An electrostatic latent image is formed on the surface of the photoconductive drum 621 by the irradiation of the laser beam B1. The developing unit supplies a developing material (a toner) of the yellow color to the surface of the photoconductive drum 621 to thereby visualize the electrostatic latent image on the surface of the photoconductive drum 621.

Similarly, the other photoconductive drums 622, 623, and 624 visualize electrostatic latent images on the surfaces thereof using developing materials of colors corresponding thereto.

A cleaner 636 is provided in a position opposed to the drive roller 626 of the image forming unit 220 across the transfer belt 12. The cleaner 636 has a cleaning blade 636*a* that is in contact with the transfer belt 12. The cleaner 636 scrapes off the developing materials remaining on the transfer belt 12 using the cleaning blade 636*a*.

A printing mode is changed as described below. Hooks 671, 672, 673, and 674 are provided near the primary transfer rollers 641, 642, 643, and 644. The hooks 671, 672, 673, and 674 engage with shafts of the primary transfer rollers 641, 642, 643, and 644 to lift the shafts while pivoting and move the primary transfer rollers 641, 642, 643, and 644 in a direction away from the photoconductive drums 621, 622, 623, and 624. Printing modes such as a full-color mode, a totally separated mode, and a monochrome mode are changed by moving none of the primary transfer rollers 641, 642, 643, and 644 or changing a combination of the primary transfer rollers to be moved.

A storing mechanism and a feeding mechanism for a recording medium are explained. Plural recording media cassettes 650 that store recording media are provided below the exposing unit 611. A large number of recording media P of recording media types different from one another are stored in the recording media cassettes 650 in a stacked state. Recording medium feeding mechanisms 221 that feed the recording media in the recording media cassettes 650 one by one from above are respectively provided in outlet portions (on the right side in the figure) of the recording media cassettes 650. The recording media P are extracted one by one from any one of the recording media cassettes 650 by each of the recording medium feeding mechanisms 221. The recording medium feeding mechanism 221 for extraction includes a pickup roller 651, a recording medium feeding roller 652*a*, and a separating roller 652*b*. The recording medium feeding mechanism 221 separates the recording media P extracted from the recording media cassette 650 one by one and feeds the recording medium P to a recording medium conveying path 653.

A conveying path for a recording medium is explained. The recording medium conveying path 653 extends to a recording medium discharge port 654 in an upper part through the driven roller 10 of the image forming unit 220. The recording medium discharge port 654 faces a recording medium discharging unit 655 that continues to an outer peripheral surface of the apparatus main body 601. Conveying rollers 656 are respectively provided near the recording medium feeding mechanisms 221 on a start end side of the conveying path 653. When a recording medium is fed by any one of the recording medium feeding mechanisms 221, the fed recording medium is conveyed to the recording medium discharging unit 655 through the recording medium conveying path 653.

A secondary transfer roller 11 is provided in a position opposed to the driven roller 10 across the transfer belt 12 along the recording medium conveying path 653. Registration rollers 658 are provided in a position in a conveying direction before the driven roller 10 and the secondary transfer roller 11.

The registration rollers 658 feed the recording medium P into between the transfer belt 12 and the secondary transfer roller 11 at timing synchronizing with a transfer operation, which is an operation for transferring an image formed by a developing material (a toner) onto a recording medium, by the transfer belt 12 and the secondary transfer roller 11. The secondary transfer roller 11 transfers a visible image formed by the developing material (the toner), which is transferred onto the transfer belt 12, onto the recording medium P and prints the visible image while holding the recording medium P, which is fed from the registration rollers 658, between the secondary transfer roller 11 and the transfer belt 12 on the driven roller 10. In this way, the registration rollers 658 convey the recording medium P to the image forming unit 220 including the transfer belt 12 and the secondary transfer roller 11 in synchronization with the transfer operation of the image forming unit 220.

A heat roller 659 for thermal fixing and a press contact roller 660 that is in contact with the heat roller 659 are provided in a position further on a downstream side than the secondary transfer roller 11 on the recording medium conveying path 653. The image transferred onto the recording medium P is fixed by the heat roller 659 and the press contact roller 660. Recording medium discharging rollers 661 are provided at a terminal end of the recording medium conveying path 653.

An automatic duplex unit (hereinafter referred to as ADU) 222 may be provided in the apparatus main body 601. The ADU 222 is set to couple a sub-conveying path 662, which is a path to convey the recording medium P in the ADU 222, to the terminal end of the recording medium conveying path 653 and an inlet of the registration rollers 658. The sub-conveying path 662 branches from a downstream side relative to the image forming unit 220 on the recording medium conveying path 653 (the terminal end of the recording medium conveying path 653) and merges into an upstream side relative to the image forming unit 220 on the recording medium conveying path 653 (an upstream side position of the registration rollers 658).

The sub-conveying path 662 reverses the front and the back of the recording medium P for duplex printing. Recording medium feeding rollers 663, 664, and 665 are provided in the sub-conveying path 662. The ADU 222 reversely feeds the recording medium P conveyed from the image forming unit 220 to the recording medium discharging unit 655, conveys the recording medium P through the sub-conveying path 662, and merges the recording medium P into the recording medium conveying path 653 on an upstream side of the image forming unit 220. When the recording medium P is conveyed in this way, the front and the back of the recording medium P is reversed.

The recording medium P returned to the upstream side of the image forming unit 220 through the sub-conveying path 662 merges into the recording medium conveying path 653. Then, in synchronization with the transfer operation of the image forming unit 220, the recording medium P is fed into a transfer position, where the transfer belt 12 and the secondary transfer roller 11 are in contact, by the registration rollers 658. In this way, the visible image on the transfer belt 12 is transferred onto the rear surface of the recording medium P as well and printed thereon.

When duplex printing is designated by, for example, an operation panel 724 provided in the apparatus main body 601 or a computer or the like connected to the apparatus main body 601 through a network, the sub-conveying path 662 of the ADU 222 changes to a state for performing an operation for reversing the front and the back of the recording medium P.

Devices additionally provided in the image forming apparatus are explained. In the example of the apparatus main body 601 shown in FIG. 6, two recording media cassettes 650 are provided as feeding sources of recording media. Three or more recording media cassettes 650 may be provided in the apparatus main body 601. Besides, although not shown in the figure, a manual-feed recording medium feeding mechanism (hereinafter referred to as SFB) or a large-capacity recording medium feeder (hereinafter referred to as LCF) as a recording medium feeding mechanism, which can store several thousand recording media in a stacked state, can also be provided. The SFB or the LCF is set in the apparatus main body 601 such that a path of the SFB or the LCF for feeding recording media merges into the recording medium conveying path 653.

A recording medium type sensor 223 may be provided in the apparatus main body 601. The recording medium type sensor 223 is arranged in a position on the upstream side relative to the image forming unit 220 on the recording medium conveying path 653 and further on the upstream side than the registration rollers 658. The recording medium type sensor 223 detects a recording medium type of the recording medium P conveyed through the recording medium conveying path 653.

As the recording medium type sensor 223, for example, a publicly-known sensor that judges a type of the recording medium P by detecting the thickness and the light transmittance of the recording medium P can be used.

When the SFB or the LCF is set, the recording medium type sensor 223 is arranged further on the downstream side than a merging point of the recording medium feeding path from the SFB or the LCF and the recording medium conveying path 653. By arranging the recording medium type sensor 223 in this way, it is possible to detect, with one recording medium type sensor 223, types of the recording media P conveyed on the recording medium conveying path 653 from all the recording medium feeding sources. Secondary-transfer-roller releasing mechanism

First Embodiment

Figure 1:
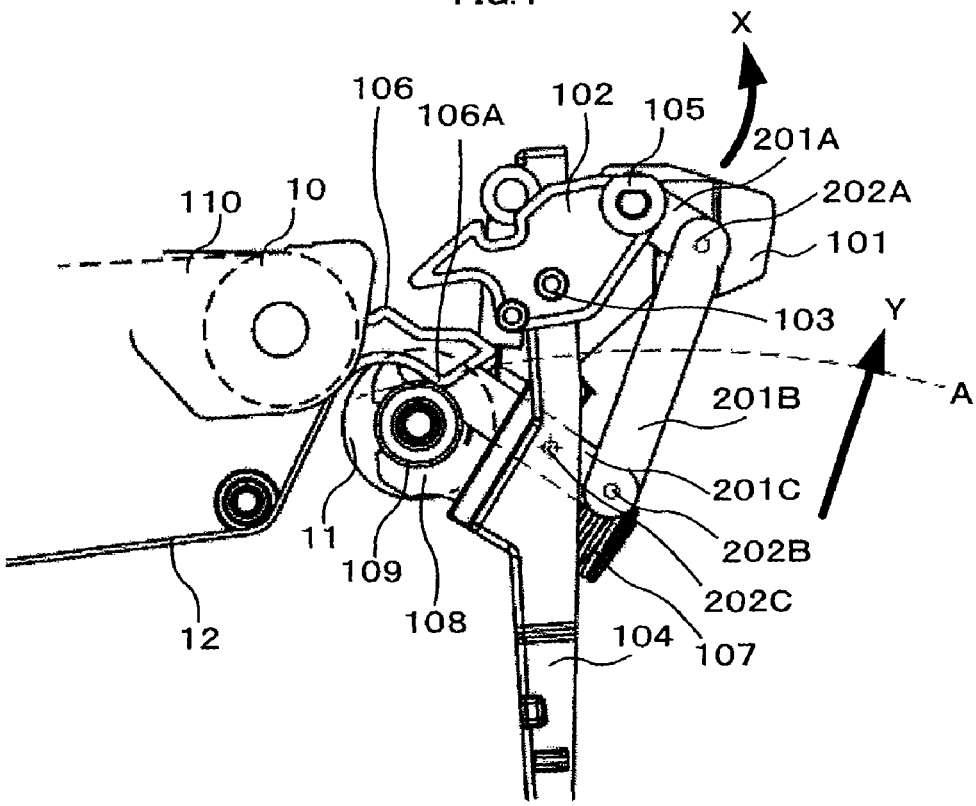
FIG. 1 is a diagram of a secondary-transfer-roller releasing mechanism according to a first embodiment of the present invention.

FIG. 1 is a diagram of a secondary-transfer-roller releasing mechanism according to this embodiment. As shown in FIG. 1, a roller guide 108 supports a rotating shaft of the secondary transfer roller 11. A positioning spring 107 slidably supports the roller guide 108. A broken line A indicates a track of pivoting of the secondary transfer roller 11. A supporting frame 104 supports the positioning spring 107. The positioning spring 107 pushes the secondary transfer roller 11 in a direction of the driven roller 10 and brings the secondary transfer roller 11 into press contact with the driven roller 10 and the transfer belt 12.

A driven-roller supporting frame 110, which supports the driven roller 10, supports a secondary-transfer-roller positioning member 106. The secondary-transfer-roller positioning member 106 comes into contact with a secondary-transfer-roller-side positioning member 109 and positions the secondary transfer roller 11 in a predetermined position.

The supporting frame 104 pivotably supports a pivoting arm 102 at a pivotal fulcrum 103. The pivoting arm 102 is locked to a release handle 101 and a fixed fulcrum 105. A housing frame pivotably supports the supporting frame 104.

The pivoting arm 102 locks a first coupling arm 201A to the fixed fulcrum 105. The first coupling arm 201A pivotably locks a second coupling arm 201B to a first coupling point 202A. The second coupling arm 201B pivotably locks a third coupling arm 201C to a second coupling point 202B. The supporting frame 104 pivotably locks the third coupling arm 201C to a third coupling point 202C. The third coupling arm 201C brings a contact portion of the third coupling arm 201C, which is one end on the opposite side of the second coupling point 202B relative to the third coupling point 202C, into contact with the secondary-transfer-roller-side positioning member 109.

With a power point set in the second coupling point 202B, a fulcrum set in the third coupling point 202C, and an action point set in the contact portion of the third coupling arm 201C, the third coupling arm 201C pushes down the secondary transfer roller 11 using leverage.

When the release handle 101 is pulled up in an arrow X direction, the first coupling arm 201A pivots in the arrow X direction following the release handle 101. When the first coupling arm 201A pivots in the arrow X direction, the second coupling arm 201B moves in an arrow Y direction.

Figure 2:
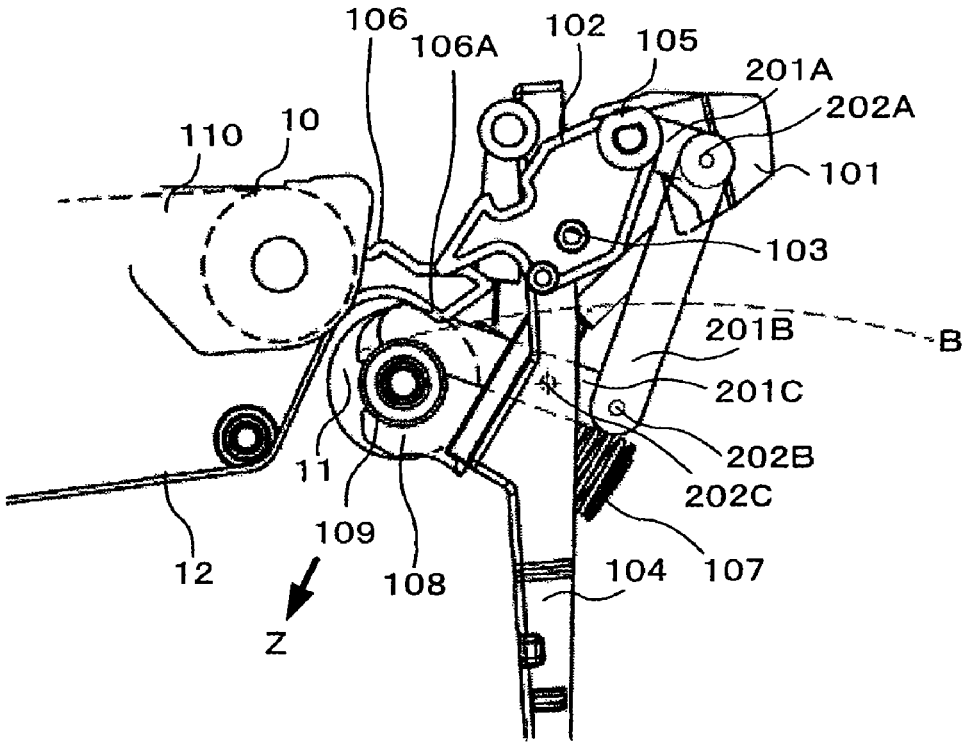
FIG. 2 is a diagram of a state in which a release handle is pulled up.

FIG. 2 is a diagram of a state in which the release handle 101 is pulled up. As shown in FIG. 2, when the second coupling arm 201B moves in the arrow Y direction, the third coupling arm 201C pivots around the third coupling point 202C and pushes the secondary-transfer-roller-side positioning member 109 to push down the secondary transfer roller 11 in an arrow Z direction.

When the secondary transfer roller 11 is pushed down in the arrow z direction, the secondary-transfer-roller-side positioning member 109 separates from a contact portion 106A of the secondary-transfer-roller positioning member 106. Therefore, the track of the secondary transfer roller 11 falls to a broken line B. When the secondary transfer roller 11 is released, the secondary-transfer-roller-side positioning member 109 is not caught in the contact portion 106A. Therefore, it is possible to smoothly release the secondary transfer roller 11.

As explained above, the image forming apparatus according to this embodiment includes the coupling arm that moves, when the release handle 101 is pulled up, in association with the movement of the release handle 101 and separates the secondary transfer roller 11 from the secondary-transfer-roller positioning member 106. Therefore, the image forming apparatus according to this embodiment has an effect that, when the secondary transfer roller 11 is released, the secondary-transfer-roller-side positioning member 109 is not caught in the contact portion 106A and the secondary transfer roller 11 can be smoothly released.

Second Embodiment

Figure 3:
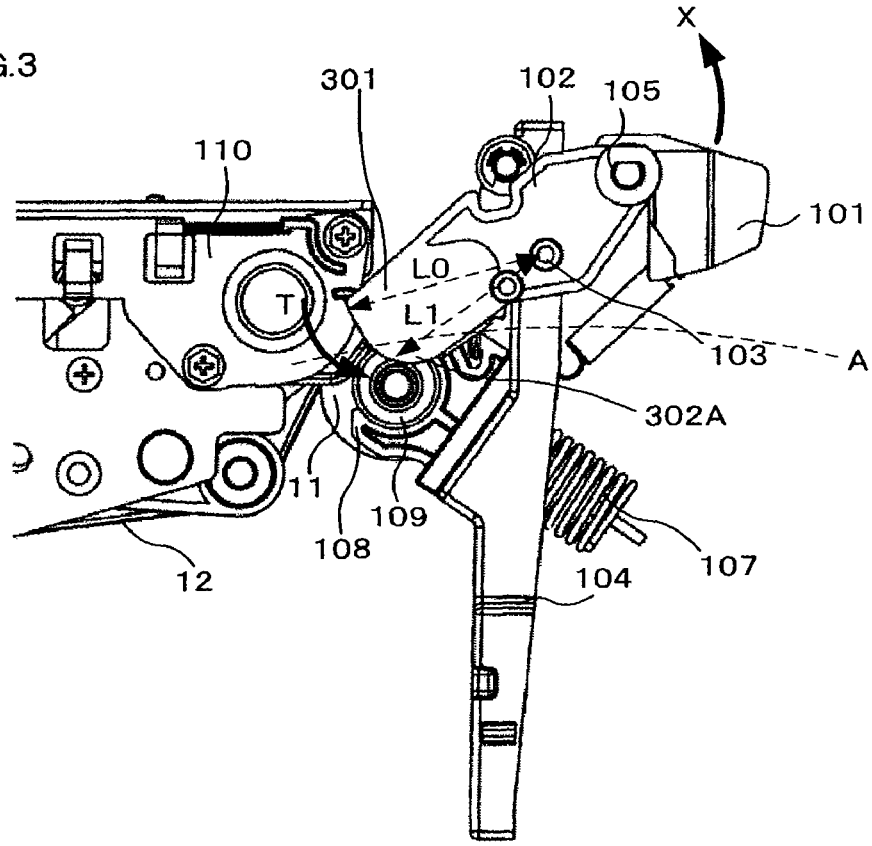
FIG. 3 is a diagram of a secondary-transfer-roller releasing mechanism according to a second embodiment of the present invention.

FIG. 3 is a diagram of a secondary-transfer-roller releasing mechanism according to a second embodiment of the present invention. As shown in FIG. 3, the roller guide 108 supports the rotating shaft of the secondary transfer roller 11. The positioning spring 107 slidably supports the roller guide 108. The broken line A indicates the track of pivoting of the secondary transfer roller 11. The supporting frame 104 supports the positioning spring 107. The positioning spring 107 pushes the secondary transfer roller 11 in a direction of the driven roller 10 and brings the secondary transfer roller 11 into press contact with the driven roller 10 and the transfer belt 12.

The driven-roller supporting frame 110, which supports the driven roller 10, supports the secondary-transfer-roller positioning member 106. The secondary-transfer-roller positioning member 106 comes into contact with the secondary-transfer-roller-side positioning member 109 and positions the secondary transfer roller 11 in a predetermined position.

The supporting frame 104 pivotably supports the pivoting arm 102 at the pivotal fulcrum 103. The pivoting arm 102 is locked to the release handle 101 and the fixed fulcrum 105. The housing frame pivotably supports the supporting frame 104. The image forming apparatus according to this embodiment can include only one pivoting arm 102 or can include one pivoting arm 102 at each of ends of the secondary transfer roller 11, two pivoting arms 102 in total.

The pivoting arm 102 has a push-down spatula 301 on the opposite side of the fixed fulcrum 105 across the pivotal fulcrum 103. The push-down spatula 301 has a curved section 302A in a distal end thereof. The curved section 302A is in contact with the secondary-transfer-roller-side positioning member 109.

The push-down spatula 301 has length enough to set the curved section 302A in contact with the secondary-transfer-roller-side positioning member 109. A distance L0 from the distal end of the push-down spatula 301 to the pivotal fulcrum 103 is larger than a distance L1 from the curved section 302A to the pivotal fulcrum 103.

A curvature radius of the curved section 302A is desirably larger than a radius of the secondary-transfer-roller-side positioning member 109. When the curvature radius of the curved section 302A is smaller than the radius of the secondary-transfer-roller-side positioning member 109, a large force may be required during a release operation.

When the release handle 101 is pulled up in the arrow X direction, the pivoting arm 102 pivots in an arrow T direction around the pivotal fulcrum 103 in association with the movement of the release handle 101. With a power point set in the release handle 101, a fulcrum set in the pivotal fulcrum 103, and an action point set in the curved section 302A, the pivoting arm 102 pushes down the secondary transfer roller 11 using leverage.

Figure 4:
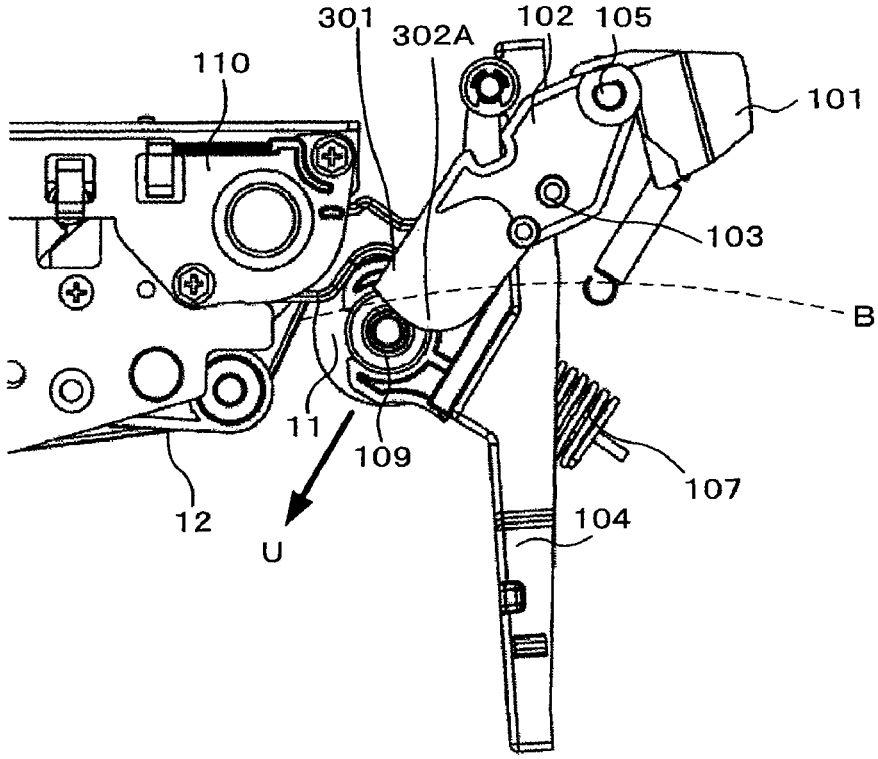
FIG. 4 is a diagram of a state in which a release handle is pulled up.
Figure 5:
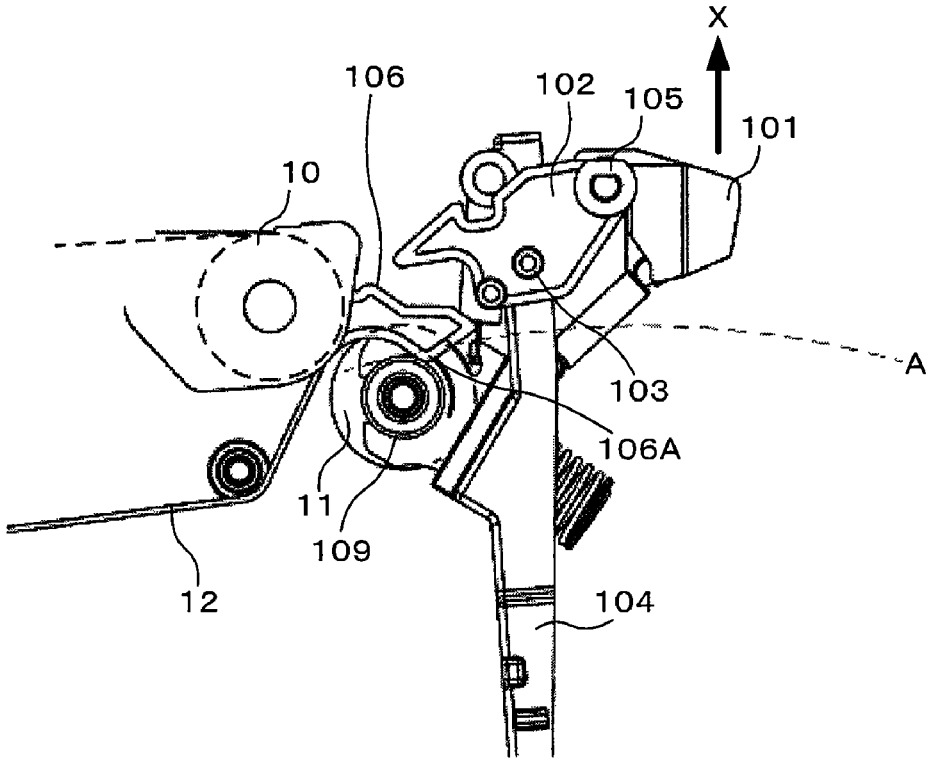
FIG. 5 is a diagram of a secondary-transfer-roller releasing mechanism according to a related art.

FIG. 4 is a diagram of a state in which the release handle 101 is pulled up. As shown in FIG. 4, when the pivoting arm 102 pivots in the arrow T direction around the pivotal fulcrum 103, the push-down spatula 301 pushes down the secondary transfer roller 11 in an arrow U direction.

When the secondary transfer roller 11 is pushed down in the arrow U direction, the secondary-transfer-roller-side positioning member 109 separates from the contact portion 106A of the secondary-transfer-roller positioning member 106. Therefore, the track of the secondary transfer roller 11 falls to the broken line B. When the secondary transfer roller 11 is released, the secondary-transfer-roller-side positioning member 109 is not caught in the contact portion 106A. Therefore, it is possible to smoothly release the secondary transfer roller 11.

As explained above, the image forming apparatus according to this embodiment includes the pivoting arm 102 having the push-down spatula 301 that moves, when the release handle 101 is pulled up, in association with the movement of the release handle 101 and separates the secondary transfer roller 11 from the secondary-transfer-roller positioning member 106. Therefore, the image forming apparatus according to this embodiment has an effect that it is possible to manufacture at lower cost a releasing mechanism in which, when the secondary transfer roller 11 is released, the secondary-transfer-roller-side positioning member 109 is not caught in the contact portion 106A and the secondary transfer roller 11 can be smoothly released.

Although exemplary embodiments of the present invention have been shown and described, it will be apparent to those having ordinary skill in the art that a number of changes, modifications, or alterations to the invention as described herein may be made, none of which depart from the spirit of the present invention. All such changes, modifications, and alterations should therefore be seen as within the scope of the present invention.

What is claimed is:

1. An image forming apparatus comprising:

a recording medium feeding mechanism that feeds recording media one by one;

a recording medium conveying path to convey the recording medium fed by the recording medium feeding mechanism to a recording medium discharging unit;

an image forming unit that is arranged further on an upstream side than the recording medium discharging unit on the recording medium conveying path and executes an image forming process to print an image based on image data on the recording medium conveyed through the recording medium conveying path;

a release handle pivotably locked to a support arm that slidably supports a secondary transfer roller of the image forming unit; and an arm that separates, when the release handle is pulled, the secondary transfer roller from a secondary-transfer-roller positioning member using leverage.

2. An image forming apparatus comprising:

a recording medium feeding mechanism that feeds recording media one by one;

a recording medium conveying path to convey the recording medium fed by the recording medium feeding mechanism to a recording medium discharging unit;

an image forming unit that is arranged further on an upstream side than the recording medium discharging unit on the recording medium conveying path and executes an image forming process to print an image based on image data on the recording medium conveyed through the recording medium conveying path;

a release handle pivotably locked to a support arm that slidably supports a secondary transfer roller of the image forming unit; and a coupling arm that separates, when the release handle is pulled, the secondary transfer roller from a secondary-transfer-roller positioning member using leverage.

3. The apparatus according to claim 2, wherein the image forming apparatus includes a plurality of coupling arms.

4. The apparatus according to claim 3, wherein the plurality of coupling arms includes:

a first coupling arm that pivots following the pivoting of the release handle;

a second coupling arm that moves following the pivoting of the first coupling arm; and a third coupling arm that is pivotably locked to the a supporting frame, pivots following the movement of the second coupling arm, and pushes down the secondary transfer roller.

5. The apparatus according to claim 4, wherein the first coupling arm is fixed to a pivoting arm pivotably locked to the supporting frame.

6. The apparatus according to claim 5, wherein the secondary transfer roller is slidably supported on the supporting frame by a roller guide, which pivotably supports a rotating shaft of the secondary transfer roller, and a positioning spring.

7. The apparatus according to claim 6, wherein the supporting frame is pivotably supported on a housing frame and, when the supporting frame is pivoted, the secondary transfer roller separates from a transfer belt of the image forming unit.

8. The apparatus according to claim 7, wherein, when the supporting frame is closed, a position of contact of the secondary transfer roller with the transfer belt is positioned by the secondary-transfer-roller positioning member.

9. An image forming apparatus comprising:

a recording medium feeding mechanism that feeds recording media one by one;

a recording medium conveying path to convey the recording medium fed by the recording medium feeding mechanism to a recording medium discharging unit;

an image forming unit that is arranged further on an upstream side than the recording medium discharging unit on the recording medium conveying path and executes an image forming process to print an image based on image data on the recording medium conveyed through the recording medium conveying path;

a release handle pivotably locked to a support arm that slidably supports a secondary transfer roller of the image forming unit; and a pivoting arm that separates, when the release handle is pulled, the secondary transfer roller from a secondary-transfer-roller positioning member.

10. The apparatus according to claim 9, wherein the image forming apparatus includes only a singular pivoting arm.

11. The apparatus according to claim 10, wherein the pivoting arm is pivotably locked to the support arm.

12. The apparatus according to claim 11, wherein the pivoting arm has a push-down spatula to push down the secondary transfer roller.

13. The apparatus according to claim 12, wherein the push-down spatula includes a curved section that is in contact with a secondary-transfer-roller-side positioning member of the secondary transfer roller.

14. The apparatus according to claim 13, wherein a curvature radius of the curved section is larger than a radius of the secondary-transfer-roller-side positioning member.

15. The apparatus according to claim 14, wherein, with a power point set in the release handle, a fulcrum set in a pivotal fulcrum, and an action point set in the curved section, the pivoting arm pushes down the secondary transfer roller using leverage.

16. The apparatus according to claim 15, wherein the push-down spatula has length enough to set the curved section in contact with the secondary-transfer-roller-side positioning member.

17. The apparatus according to claim 16, wherein a distance from a distal end of the push-down spatula to the pivotal fulcrum is larger than a distance from the curved section to the pivotal fulcrum.

18. The apparatus according to claim 17, wherein the secondary transfer roller is slidably supported on a supporting frame by a roller guide, which pivotably supports a rotating shaft of the secondary transfer roller, and a positioning spring.

19. The apparatus according to claim 18, wherein the supporting frame is pivotably supported on a housing frame and, when the supporting frame is pivoted, the secondary transfer roller separates from a transfer belt of the image forming unit.

20. The apparatus according to claim 19, wherein a position of contact of the secondary transfer roller with the transfer belt is positioned by the secondary-transfer-roller positioning member when the supporting frame is closed.

21. A method of releasing a secondary transfer roller of an image forming apparatus, the method comprising separating the secondary transfer roller from a secondary-transfer-roller positioning member by transmitting force applied to a release handle to the secondary transfer roller using leverage.

* * * * *